US007040046B2

(12) United States Patent
Renault et al.

(10) Patent No.: US 7,040,046 B2
(45) Date of Patent: May 9, 2006

(54) PRESSING IRON HAVING A HANDLE INTEGRATING AN ORIFICE FOR FILLING A RESERVOIR

(75) Inventors: Fabrice Renault, Lyons (FR); Dominique Gelus, Pont Eveque (FR); Edgar Hipp, Chazay d'Azergues (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 11/217,678

(22) Filed: Sep. 2, 2005

(65) Prior Publication Data

US 2006/0048416 A1 Mar. 9, 2006

(30) Foreign Application Priority Data

Sep. 2, 2004 (FR) ..... 04 09301

(51) Int. Cl.
*D06F 75/14* (2006.01)
*D06F 75/30* (2006.01)

(52) U.S. Cl. ..... 38/88

(58) Field of Classification Search ..... 38/88, 38/77.2, 77.4, 77.7, 77.8, 90; 219/245, 254, 219/256

See application file for complete search history.

(56) References Cited

U.S. PATENT DOCUMENTS

| | | | | | |
|---|---|---|---|---|---|
| 2,418,285 | A | * | 4/1947 | Witzel | 38/88 |
| 2,433,556 | A | * | 12/1947 | Hume | 38/77.82 |
| 2,518,503 | A | * | 8/1950 | Sparklin | 219/251 |
| 2,976,627 | A | * | 3/1961 | Kistner et al. | 38/77.7 |
| 3,718,997 | A | * | 3/1973 | Murphy | 38/90 |
| 3,969,607 | A | * | 7/1976 | Osrow et al. | 392/335 |
| 4,031,638 | A | * | 6/1977 | Ryckman et al. | 38/77.2 |

* cited by examiner

*Primary Examiner*—Ismael Izaguirre
(74) *Attorney, Agent, or Firm*—Browdy and Neimark, PLLC

(57) ABSTRACT

A pressing iron having a heating soleplate topped by a body and a handle forming a protuberance on the body of the iron, the body enclosing a reservoir. The handle presents an upper surface forming a bearing surface for the palm of the hand presenting, at least locally, a width greater than or equal to 4 cm and lateral walls extending from the upper surface of the handle to the body of the iron intended to receive the fingertips and the handle integrates a filling orifice for the reservoir opening at a surface of the handle.

16 Claims, 3 Drawing Sheets

PRESSING IRON HAVING A HANDLE INTEGRATING AN ORIFICE FOR FILLING A RESERVOIR

BACKGROUND OF THE INVENTION

The present invention relates to a pressing iron furnished with a reservoir having a filling orifice and more particularly to a pressing iron in which the handle forms a protuberance on the body of the iron.

Most steam irons have an elongated handle of cylindrical form extending along the longitudinal axis of the iron and permitting grasping of the iron by taking hold of it with a "hammer" grip of the handle. Such steam irons are generally provided with a reservoir whose filling orifice is disposed on the front part of the iron ahead of the handle. However, the filling orifice then presents the drawback of having a reduced diameter, because of the thinness of the iron at this location, which complicates the operation of filling the reservoir.

BRIEF SUMMARY OF THE INVENTION

A goal of the invention is to eliminate these drawbacks by providing a pressing iron having a handle of a particular form permitting integration of a filling orifice that has a large diameter and is easily accessible.

To this end, the invention has for its object a pressing iron having a heating soleplate topped by a body and a handle forming a protuberance on the body of the iron, the body of the iron enclosing a reservoir, characterized in that the handle has an upper surface forming a bearing surface for the palm of the hand presenting, at least locally, a width greater than or equal to 4 cm and lateral walls extending from the upper surface of the handle to the body of the iron in order to receive the fingertips of the user's hand and in that the handle integrates a filling orifice for the reservoir opening at a surface of the handle.

Such a characteristic presents the advantage of permitting the attainment of a pressing iron having a relatively voluminous handle on which the palm of the hand can rest in a relaxed position during ironing and in which can be disposed a filling orifice that is easily accessible and of large diameter.

According to another characteristic of the invention, the filling orifice is dispose at the bottom of a cavity forming a funnel converging toward the filling orifice.

Such a characteristic permits the ease of filling of the reservoir to be increased.

According to still another characteristic of the invention, the filling orifice has a diameter greater than or equal to 1.5 cm.

According to another characteristic of the invention, the filling orifice opens toward the upper surface of the handle and is concealed by a movable hatch defining at least one part of the upper surface of the handle.

Such a characteristic presents the advantage of permitting a perfect integration of the filling orifice into the body of the handle while retaining a smooth upper surface to support the palm of the hand.

According to another characteristic of the invention, the hatch is pivotally mounted on a hinge.

According to still another characteristic of the invention, the reservoir has a filling neck coming into the extension of the filling orifice and extending to the interior of the body of the handle, an annular control dial, being disposed around the filling neck, the periphery of the control dial extending laterally beyond at least one of the lateral walls of the handle.

Such a characteristic permits the utilization of a control dial of large diameter, the angular displacement of which can be effectuated very precisely by the user, thus permitting a very precise regulation of the organ controlled by the control dial.

According to other particular embodiments, the pressing iron according to the invention can comprise one or several of the following features, taken individually or in any technologically possible combination:

- the filling neck participates in the rotational guidance of the control dial;
- the control dial has a notched part cooperating with a pinion to control a thermostat for regulating the temperature of the soleplate;
- the upper surface of the handle has a transparent window facing a part of the control dial;
- the upper surface of the handle has a steam dial in proximity to the front end of the handle.

BRIEF DESCRIPTION OF THE DRAWINGS

The goals, aspects and advantages of the present invention will be better understood from the description given hereafter of a particular embodiment of the invention presented by way of non-limiting example, with reference to the attached drawings in which.

DETAILED DESCRIPTION OF THE INVENTION

Figure 1:
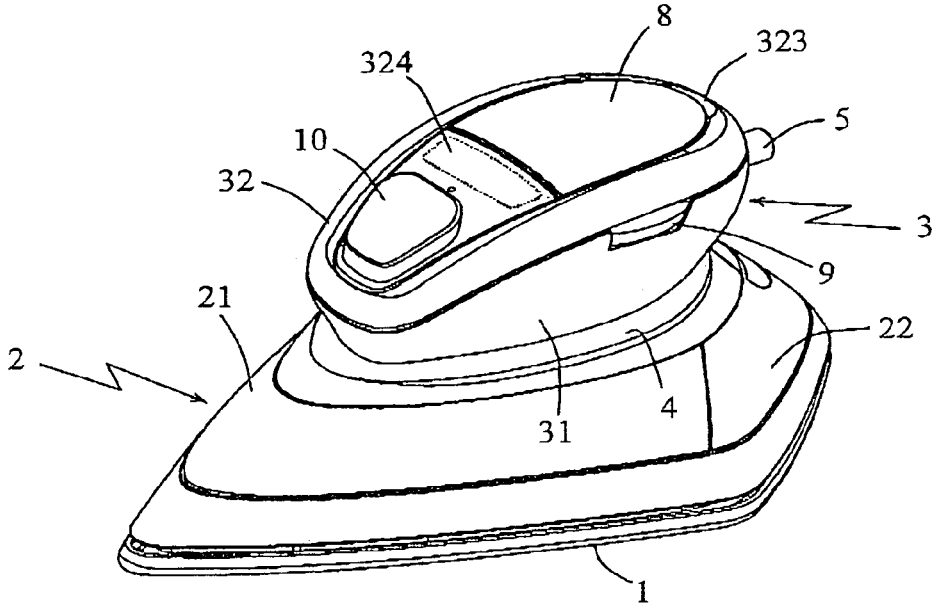
FIG. 1 is a perspective view of a pressing iron according to a particular embodiment of the invention, the hatch for closing the filling orifice being in the closed position.

FIGS. 1 to 4 represent a steam pressing iron having a heating soleplate 1, topped by a body 2 presenting the form of a dome whose base is adjusted to the contour of soleplate 1 and the top of which presents a flared part supporting a handle 3 disposed substantially above the center of soleplate 1, handle 3 forming a protuberance on body 2 of the iron.

Handle 3 has a generally one-piece form, similar to a smooth, rounded stone, usually in the form of a parallelepiped having rounded edges, and has a convex upper surface that is slightly inclined toward the front of the iron, conforming to the natural curvature of the palm and fingers of the hand when this latter is in a relaxed but slightly closed position.

The width of handle 3 at the level of its base is less than the width of the widened top of body 2 of the iron such that there results at one side and the other of the handle a rim, or edge, 4. This rim 4 serves as an abutment for the fingers of the hand when the palm rests on handle 3 and thus constitutes a protective guard preventing the fingers from accidentally coming to touch the hot walls of body 2 of the iron.

Advantageously, the width of the upper surface of handle 3 is comprised between 4 and 9 cm, and is preferably of the order of 7 cm, and its length is greater than 10 cm and preferably of the order of 13 cm.

Handle 3 has lateral walls extending advantageously over a height of the order of 4 cm and the rear of the handle has a wire guide 5 for the passage of an electric supply cord for the iron, not shown on the figures.

Figure 2:
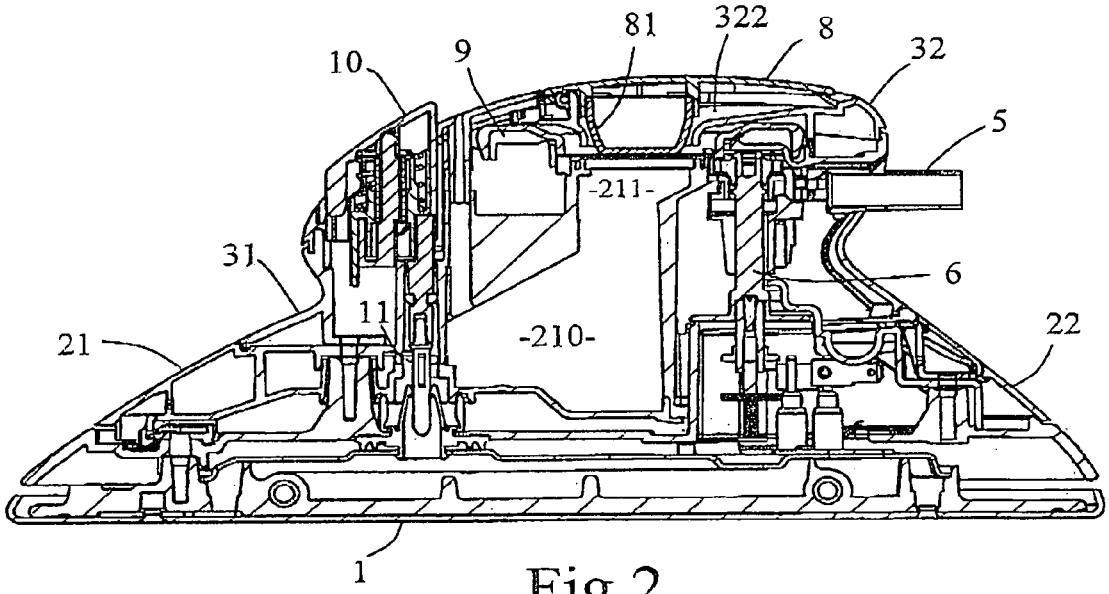
FIG. 2 is a longitudinal cross-sectional view of the iron of FIG. 1.
Figure 3:
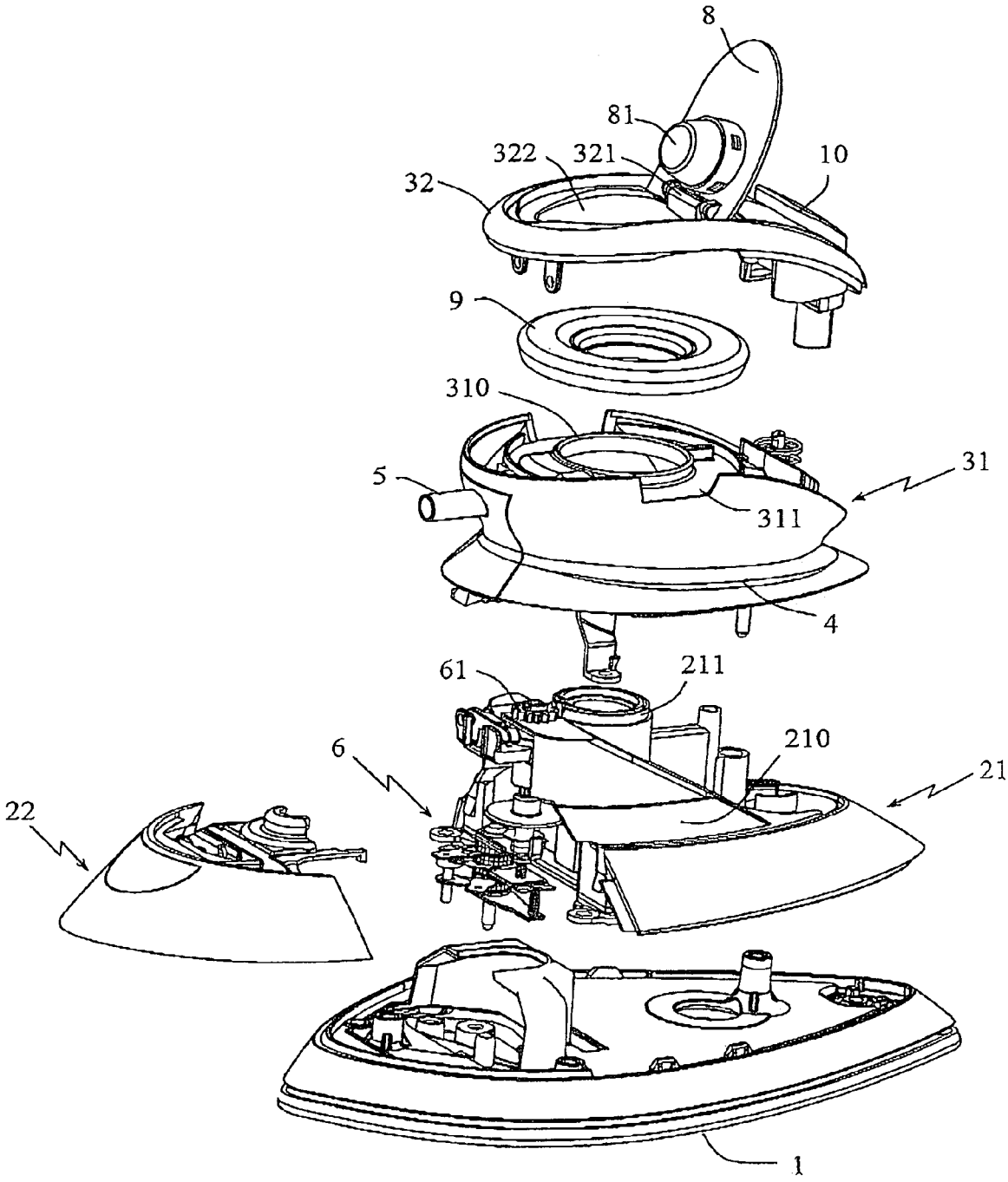
FIG. 3 is an exploded perspective view of the iron of FIG. 1.

According to FIGS. 2 and 3, body 2 of the iron is constituted essentially by a front element 21 comprising a water reservoir 210 and a rear element 22 that comes to conceal the electric supply organs for heating soleplate 1 and notably an electromechanical thermostat 6 for the soleplate, this latter being of conventional design. Water reservoir 210 supplies a steam chamber integrated into soleplate 1 through a drip plug 11.

Front element 21 and rear element 22 of body 2 are topped by a lower element 31 that prolongs body 2 of the iron and defines the lateral walls of handle 3, lower element 31 being covered by an upper element 32 defining the upper surface of handle 3.

More particularly according to the invention, lower element 31 of handle 3 comes to surround a filling neck 211 of reservoir 210 carried by front element 21 of body 2. Neck 211 extends vertically in the direction of the upper surface of handle 3 and opens through an opening 310 of lower element 31 of the handle in order to come opposite a filling orifice 7 present in upper element 32 of the handle, visible in FIG. 4. Advantageously, this filling orifice 7 has a diameter greater than or equal to 15 mm in order to assure a large flow rate facilitating filling of reservoir 210 under a faucet.

Upper element 32 of the handle has a pivoting hatch 8 articulated around a hinge 321, hatch 8 extending over substantially the entire width of handle 3 and being able to occupy a closed position, shown in FIG. 1, in which hatch 8 covers filling orifice 7. In this position, hatch 8 is flush with the rest of the upper surface of handle 3 and filling orifice 7 is closed by a plug 81 carried by hatch 8.

Figure 4:
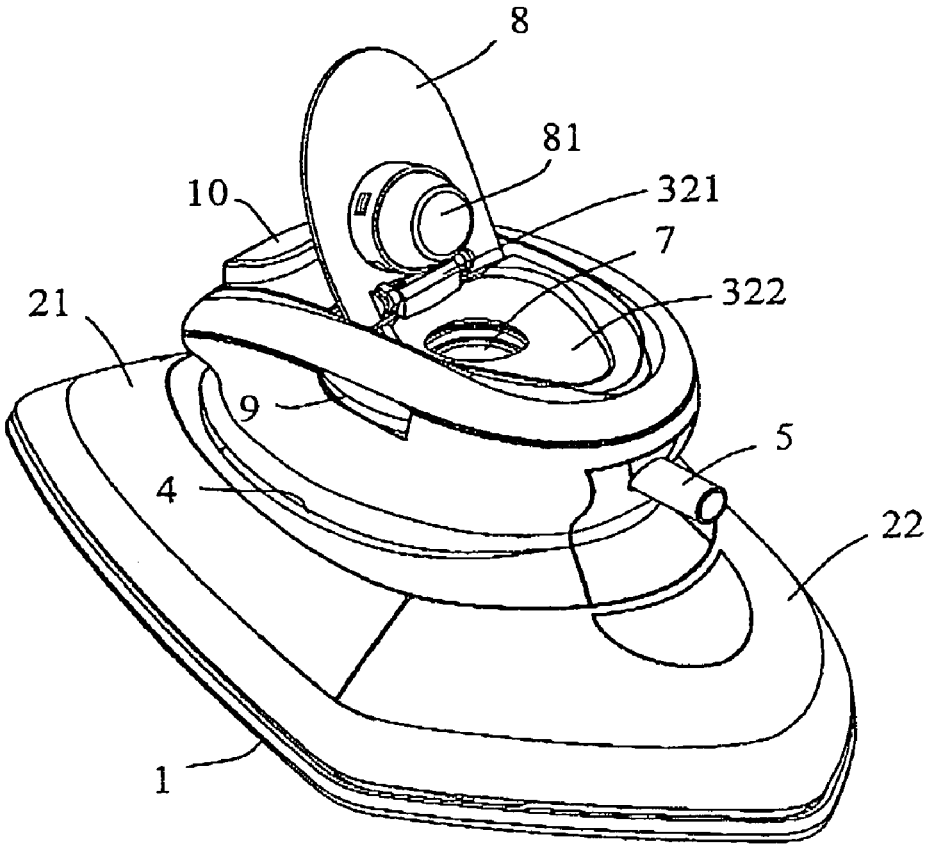
FIG. 4 is another perspective view of the iron of FIG. 1 when the filling orifice hatch is in the open position.

Hatch 8 can equally occupy in a stable manner an open position, represented in FIG. 4, in which it unblocks access to filling orifice 7 as well as the area around this orifice 7, these latters presenting the form of a cavity 322, converging toward filling orifice 7, playing the role of a funnel during filling of reservoir 210. Cavity 322 preferably extends over substantially the entire width of handle 3. An indentation 323 is advantageously provided on upper element 32 at the border of hatch 8 to facilitate raising of this latter.

The iron also has a regulating dial 9 for thermostat 6 which is interposed between lower element 31 and upper element 32 of handle 3. This regulating dial presents the form of a ring gear and has a central sleeve 91 coming to engage around the cylindrical extremity of filling neck 211 of the reservoir, this latter assuring guidance in rotation of regulating dial 9 and having a slightly reduced outer diameter so that there results a shoulder on which the lower extremity of central sleeve 91 comes to bear.

The outer diameter of regulating dial 9 of the thermostat is preferably slightly greater than the width of handle 3 at the level of filling orifice 7 so that a part of regulating dial 9 extends laterally beyond handle 3, through openings 311 provided on the lateral walls of handle 3, thus permitting manipulation of regulating dial 9 by the user.

Figure 5:
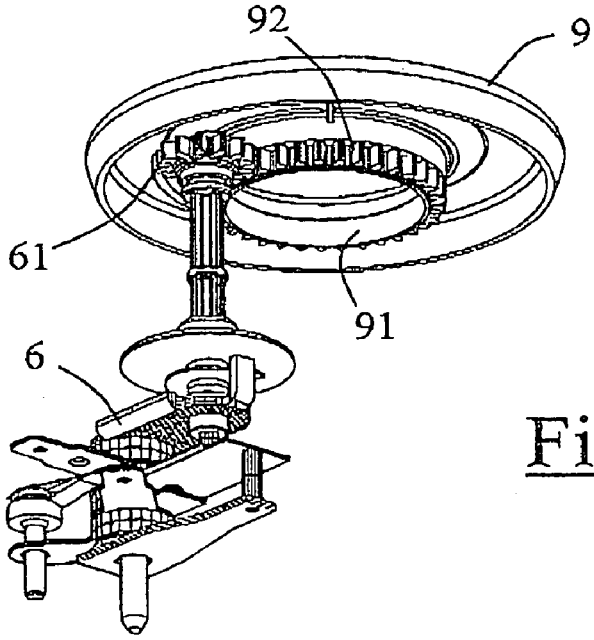
FIG. 5 is a perspective detail view, to a larger scale than the other figures, of a thermostat system of the iron and of its regulating dial.

According to FIG. 5, the outer surface of central sleeve 91 of the regulating dial is notched, or toothed, in a manner to form a toothed wheel 92 cooperating with a pinion 91 of smaller diameter, fixed to the regulating shaft of the thermostat for soleplate 1 disposed at the rear of front element 21, thus permitting a very precise regulation of the thermostat.

In an advantageous manner, upper element 32 of handle 3 is furnished with a transparent window 324, represented in a dotted line in FIG. 1, disposed in front of hatch 8 and aligned with the upper face of regulating dial 9. Preferably, dial 9 presents a large surface that can be covered with pictograms illustrating different regulating temperatures of the thermostat.

Upper element 32 of the handle equally has an opening for the passage of a bistable steam button 10 situated in proximity to the front end of the upper surface of handle 3, this button being able to occupy a first stable position in which the drip plug 11 is closed, for dry ironing, and a second stable position in which plug 11 allows water to pass in the direction of the steam chamber to effectuate steam ironing.

The steam iron thus created, in which the filling orifice of the reservoir is disposed at the level of the upper surface of a multidirectional handle having a substantial width, presents the advantage of permitting easy filling of the reservoir, the filling orifice being highly accessible and being able to have a substantial diameter.

In addition, such an arrangement permits the placement of a large diameter dial for regulating the thermostat of the soleplate around the filling orifice, which permits a highly precise regulation of the thermostat and offers a good readability of the pictograms present on the regulating dial, taking into account the large surface area available on the dial.

Of course, the invention is not in any way limited to the embodiment described and illustrated, which is given only by way of example. Modifications remain possible, particularly from the point of view of the construction of the various elements or by substitution of technical equivalents, without departing for that matter from the field of protection of the invention.

Thus, in a variation of construction, not shown, the filling orifice can open directly on the upper surface of the handle and not be concealed.

In another variation of construction of the invention, the filling orifice can open onto one or more lateral surfaces of the handle.

This application relates to subject matter disclosed in French Application number FR 04 09301, filed on Sep. 2, 2004, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A pressing iron comprising:

a heating soleplate;

a body overlying said soleplate;

a handle forming a protuberance on said body, said handle having an upper surface forming a bearing surface for the palm of a user's hand, said surface having, at least locally, a width greater than or equal to 4 cm and lateral walls extending from said upper surface of said handle to said body for receiving the fingertips of the user's hand;

a reservoir within said body; and a filling orifice within said handle, said filling orifice communicating with said reservoir and opening at a surface of said handle, wherein:

said reservoir has a filling neck communicating with said filling orifice and extending within said body, said iron further comprises an annular control dial disposed around said filling neck, and said control dial has an outer periphery extending laterally beyond at least one of the lateral walls of said handle.

2. The pressing iron according to claim 1, wherein said filling neck is constructed to guide rotational movements of said control dial.

3. The pressing iron according to claim 2, wherein said control dial has a notched part cooperating with a pinion to control a thermostat for regulating the temperature of said soleplate.

4. The pressing iron according to claim 3, wherein said upper surface of the handle has a transparent window facing a part of said control dial.

5. The pressing iron according claim 4, wherein said handle has a front end, and said iron further comprises a steam control button in said upper surface of said handle in proximity to said front end of said handle.

6. The pressing iron according claim 3, wherein said handle has a front end, and said iron further comprises a steam control button in said upper surface of said handle in proximity to said front end of said handle.

7. The pressing iron according to claim 2, wherein said upper surface of the handle has a transparent window facing a part of said control dial.

8. The pressing iron according claim 7, wherein said handle has a front end, and said iron further comprises a steam control button in said upper surface of said handle in proximity to said front end of said handle.

9. The pressing iron according claim 2, wherein said handle has a front end, and said iron further comprises a steam control button in said upper surface of said handle in proximity to said front end of said handle.

10. The pressing iron according to claim 1, wherein said control dial has a notched part cooperating with a pinion to control a thermostat for regulating the temperature of said soleplate.

11. The pressing iron according to claim 10, wherein said upper surface of the handle has a transparent window facing a part of said control dial.

12. The pressing iron according claim 11, wherein said handle has a front end, and said iron further comprises a steam control button in said upper surface of said handle in proximity to said front end of said handle.

13. The pressing iron according to claim 1, wherein said upper surface of the handle has a transparent window facing a part of said control dial.

14. The pressing iron according claim 13, wherein said handle has a front end, and said iron further comprises a steam control button in said upper surface of said handle in proximity to said front end of said handle.

15. The pressing iron according claim 1, wherein said handle has a front end, and said iron further comprises a steam control button in said upper surface of said handle in proximity to said front end of said handle.

16. The pressing iron according claim 1, wherein said filling orifice opens at said upper surface of said handle.

* * * * *